US011885134B2

(12) United States Patent
Burt et al.

(10) Patent No.: US 11,885,134 B2
(45) **Date of Patent: *Jan. 30, 2024**

(54) STAIR ASSEMBLY WITH RISE ADJUSTABLE STEP SUPPORT BRACKETS

(71) Applicant: Fortress Iron, LP, Garland, TX (US)

(72) Inventors: Kevin T. Burt, Dallas, TX (US); Kevin B. Flatt, Garland, TX (US); Matthew Carlyle Sherstad, Dallas, TX (US); Geoff T. Luczycki, Garland, TX (US); Robert Holthaus, Garland, TX (US); Aaron Jesiolowski, Garland, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/386,908

(22) Filed: Jul. 28, 2021

(65) Prior Publication Data

US 2021/0355686 A1 Nov. 18, 2021

Related U.S. Application Data

(63) Continuation of application No. 16/595,157, filed on Oct. 7, 2019, now Pat. No. 11,085,191.

(Continued)

(51) Int. Cl.
*E04F 11/025* (2006.01)
*E04F 11/104* (2006.01)

(Continued)

(52) U.S. Cl.
CPC ..... *E04F 11/1041* (2013.01); *E04F 11/0255* (2013.01); *E04F 2011/0209* (2013.01)

(58) Field of Classification Search
CPC ..... E04F 11/0255; E04F 11/1041; E04F 2011/0209

(Continued)

(56) References Cited

U.S. PATENT DOCUMENTS 17,234 A * 5/1857 Robinson ..... E04F 11/025 52/191
71,436 A * 11/1867 Adkins ..... E04F 11/0255 52/183

(Continued)

FOREIGN PATENT DOCUMENTS

CA 2857319 1/2016
DE 22 09 317 9/1973

(Continued)

OTHER PUBLICATIONS

International Search Report and Written Opinion for International Application No. PCT/US2019/055033, dated Mar. 17, 2020, 14 pages.

(Continued)

*Primary Examiner* — Brian D Mattei
*Assistant Examiner* — Joseph J. Sadlon
(74) *Attorney, Agent, or Firm* — Foley & Lardner LLP; John J. May

(57) ABSTRACT

A stair assembly includes at least one joist comprising an upper wall, a first lateral wall extending from the upper wall, and a second lateral wall extending from the upper wall. At least one stair step support bracket includes a tray support wall, a first side wall extending from the tray support wall, and a second side wall extending from the tray support wall. The first and second side walls define a pair of first front aligned positioning holes configured to receive a first set pin and a pair of first rear aligned positioning holes configured to receive a second set pin. The pairs of first front and rear aligned positioning holes disposed such that when the first and second set pins received therethrough contact the upper wall of the at least one joist, the tray support wall is positioned at a first rise dimension.

18 Claims, 6 Drawing Sheets

Related U.S. Application Data

(60) Provisional application No. 62/742,829, filed on Oct. 8, 2018.

(51) Int. Cl.
*E04F 11/04* (2006.01)
*E04F 11/02* (2006.01)

(58) Field of Classification Search
USPC ..... 52/188
See application file for complete search history.

(56) References Cited

U.S. PATENT DOCUMENTS 559,081 A 4/1896 Kandeler
624,782 A * 5/1899 Fuchs ..... E06C 1/387 182/1
1,075,156 A * 10/1913 Nedsall ..... E04F 11/025 52/191
1,265,949 A * 5/1918 Osborn ..... E04F 11/022 52/189
1,848,085 A 3/1932 Eisenschmidt
2,949,703 A 8/1960 Katzmarek
3,299,590 A 1/1967 Lavoy
3,331,579 A * 7/1967 Petersen ..... F16B 9/052 52/191
3,381,775 A 5/1968 Livers
3,612,472 A * 10/1971 Steigerwaldt, Jr. ... E04G 13/062 425/169
3,814,371 A * 6/1974 Locricchio ..... E04C 5/04 249/207
3,823,910 A * 7/1974 Crozier ..... B28B 7/225 249/14
4,422,270 A 12/1983 Lapointe et al.
4,631,880 A * 12/1986 Leicht ..... E04F 11/0255 182/228.3
4,635,416 A * 1/1987 Ayala ..... E04F 11/022 182/220
4,709,520 A * 12/1987 Vochatzer ..... E04F 11/025 182/220
4,775,131 A * 10/1988 Baumgartner ..... E04G 13/062 33/562
4,875,315 A * 10/1989 Champagne ..... E04F 11/025 52/191
4,926,590 A * 5/1990 Harris ..... E04H 3/126 52/645
5,205,093 A 4/1993 Schuette
5,636,483 A 6/1997 Wille
5,791,101 A * 8/1998 Wallace ..... E04F 11/025 52/182
5,806,254 A 9/1998 Bennett
5,899,032 A 5/1999 Buzby
5,983,580 A * 11/1999 Carr ..... E04F 11/032 52/182
6,088,977 A 7/2000 Lawrence
6,230,454 B1 5/2001 Meagher
6,516,582 B2 * 2/2003 Paul ..... E04B 9/30 52/506.07
6,758,016 B2 * 7/2004 Gobeil ..... E04F 11/1041 33/476
D503,634 S 4/2005 Emerson
7,077,386 B1 * 7/2006 Gray, Jr. ..... E04F 11/1834 256/65.03
7,089,707 B2 8/2006 Uglietto et al.
7,234,780 B2 6/2007 Lipniarski
7,946,085 B2 5/2011 Prins
7,954,249 B1 * 6/2011 Perkey ..... E04F 21/26 33/476
7,971,399 B1 * 7/2011 Ronsheim ..... E04F 11/022 52/191
8,307,603 B1 * 11/2012 Mitchell ..... E04F 21/26 52/191
8,376,309 B2 2/2013 Merriam
8,453,395 B2 * 6/2013 Couture ..... E04F 11/108 52/182
8,915,031 B2 12/2014 Dixon
9,212,491 B1 * 12/2015 Santini ..... E04F 11/025
9,309,675 B2 4/2016 Kvols
9,644,376 B2 * 5/2017 Stanaland ..... E04G 27/00
9,725,904 B2 * 8/2017 Naccarato ..... E04F 15/06
10,745,924 B2 8/2020 Jean
2002/0124492 A1 9/2002 Gobeil
2003/0208971 A1 11/2003 Couture
2009/0013633 A1 * 1/2009 Aubuchon ..... B21D 13/02 52/634
2009/0188182 A1 * 7/2009 Iannotta ..... E04F 11/1842 29/897.3
2009/0205267 A1 8/2009 Prins
2009/0293385 A1 12/2009 Vargas
2012/0167494 A1 7/2012 Brooks et al.
2013/0000231 A1 1/2013 Greaves et al.
2017/0356196 A1 12/2017 Jean
2019/0249441 A1 * 8/2019 Edwards ..... E04F 11/02

FOREIGN PATENT DOCUMENTS

DE 202011002694 U1 * 6/2011 ..... E04F 11/035
EP 0 330 45 11/1984
EP 1 524 383 A2 4/2005
GB 1575091 A * 9/1980 ..... E04F 11/0201
GB 2 545 506 A 6/2017
JP 01-174757 7/1989
KR 200395591 Y1 * 9/2005 ..... E04F 11/1041
KR 20110039863 A * 4/2011 ..... E04F 11/1041
WO WO-89/02506 3/1989
WO WO-97/47833 A1 12/1997

OTHER PUBLICATIONS

Foreign Search Report on EP 19871318.2 dated Jun. 7, 2022.
Foreign Search Report on EP dated Sep. 2, 2022.

* cited by examiner

STAIR ASSEMBLY WITH RISE ADJUSTABLE STEP SUPPORT BRACKETS

PRIORITY CLAIM

This application is a continuation of U.S. patent application Ser. No. 16/595,157, filed on Oct. 7, 2019, now pending, which claims priority to U.S. Provisional Application for Patent Ser. No. 62/742,829, entitled "Stair Stringer with Rise Adjustable Step Supports," filed on Oct. 8, 2018, the disclosures of which are hereby incorporated by reference.

BACKGROUND OF THE INVENTION

Stair stringers may be difficult to assemble because each step support bracket must be precisely positioned on a joist to ensure that the stairs consistently have the desired rise and run. Repeated measurements are taken to ensure proper placement of the stair support members. The present disclosure significantly simplifies the assembly of a stair stringer and virtually ensures consistent and repeatable placement of each stair support bracket. Furthermore, according to one embodiment, consistent placement of each stair support bracket is accommodated for a variety of stair angles corresponding to different rise dimensions of various stairways.

SUMMARY

A stair stringer includes a pair of joists each including an upper wall, a first lateral wall extending from the upper wall, and a second lateral wall extending from the upper wall. At least one stair step support bracket includes a tray support wall, a first side wall extending from the tray support wall, a second side wall extending from the tray support wall, and a front wall extending between the first side wall and the second side wall. The at least one stair step support bracket is configured to set on the upper wall of one of the pair of joists and the first side wall extending downward beyond the upper wall of the one joist in position to receive a first fastener through the first side wall and into the first lateral wall of the one joist, and the second side wall extending downward beyond the upper wall of the one joist in position to receive a second fastener through the second side wall and into the second lateral wall of the one joist, wherein the tray support wall is level.

According to one embodiment, the front wall and the tray support wall of the stair step support bracket contacts the upper wall of the joist and the tray support wall is positioned level at a preset rise dimension.

According to a second embodiment, a stair assembly includes a pair of joists and at least one stair step support bracket that includes a tray support wall and a pair of side walls extending from the tray support wall and a first pair of front positioning holes and a first pair or rear positioning holes formed in the side walls and corresponding to a first rise dimension, and a second pair of front positioning holes and a second pair of rear positioning holes formed in the side walls and corresponding to a second rise dimension different from the first rise dimension. A first set pin is configured to be received by the first pair of front positioning holes or the second pair of front positioning holes, and a second set pin configured to be received by the first pair of rear positioning holes or the second pair of rear positioning holes. Receiving the first set pin through the first pair of front positioning holes and second set pin through the first pair of rear positioning holes and setting the first and second pins on the upper wall of the joist positions the tray support wall level and at the first rise dimension. Alternatively, receiving the first set pin through the second pair of front positioning holes and the second set pin through the second pair of rear positioning holes and setting the first and second set pins on the upper wall of the joist positions the tray support wall level and at the second rise dimension.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
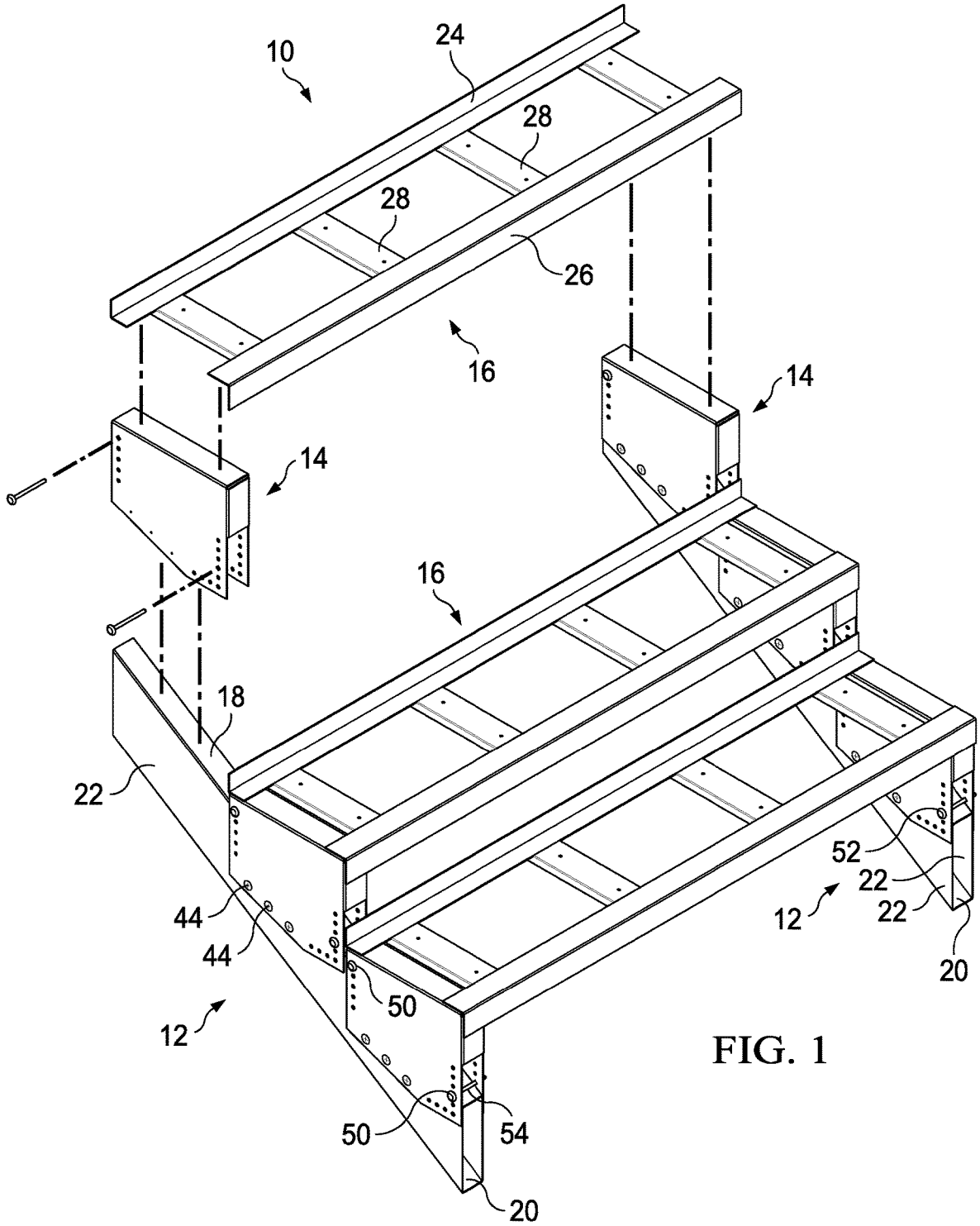
FIG. 1 is a perspective partially exploded view of a stair stringer according to an embodiment of the present disclosure.

Referring generally to the figures, FIG. 1 is a partially exploded, perspective view of a stair assembly 10. The stair assembly 10 includes trays supported by a stair stringer that includes joists and adjustable stair step support brackets. The trays and stair stringer may be made of sheet metal, such as steel and may support wood or composite polymeric boards that form the treads and risers. According to some embodiments, the stairs may lead from a ground surface to an elevated deck surface of an outdoor deck.

The stair assembly 10 includes a pair of joists 12, a plurality of adjustable stair step supports or brackets 14, and a plurality of trays 16. According to some embodiments, the stair step supports 14 are adjustable to accommodate different angles for the stair stringer that correspond to different rises of the steps. According to an alternate embodiment, the step supports are formed to support stairs at a specific predetermined angle and rise, for example 7 inches or 7 and ¾ inches.

The joists 12 may have any suitable shape. According to one embodiment, the joists 12 are tubular with a rectangular cross section and are open at each end of the joist 12. The joists 12 include an upper wall 18, a lower wall 20, and a pair of opposed lateral walls 22. The joists may be formed of 16 gauge steel or other suitable metal. As described in more detail below, the upper wall 18 can be used to temporarily set the stair step support brackets 14 at a particular rise corresponding to a particular angle at which the joists 12 are set. According to some embodiments, the joists 12 are formed by conventional sheet metal forming techniques, such as roll forming or press brake forming.

The trays 16 are each supported by a pair of adjustable stair step support brackets 14. The trays 16 are formed of sheet metal components that are welded together or otherwise joined. The tray 16 includes an upper/rear angle bar 24 separated from a lower/front angle bar 26 by a plurality of spacing members 28. The spacing members 28 may be formed of a sheet metal formed in a U-shape. According to certain embodiments, the trays 16 are formed of sheet metal by conventional sheet metal forming techniques. Each angle bar 24, 26 may have any suitable length, for example approximately 48 inches.

Figure 2:
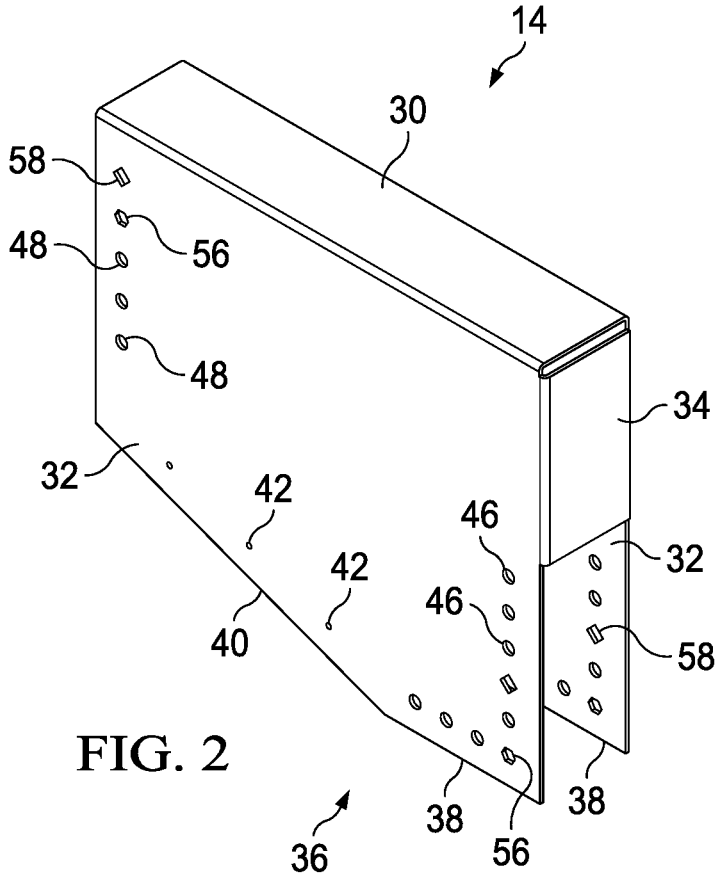
FIG. 2 is a perspective view of an adjustable stair step support bracket according to an embodiment of the present disclosure.

FIG. 2 is a perspective view of an adjustable stair step support 14 also referred to as a bracket. The adjustable stair support bracket 14 includes a tray support or upper wall 30 and a pair of lateral walls 32 extending from the tray support wall 30. A front wall 34 is disposed between front portions of the lateral walls 32. Each of the lateral walls 32 includes a bottom edge 36. The bottom edge 36 includes a horizontal edge portion 38 and an angled edge portion 40. The angle formed by the angled edge portion 40 with respect to the horizontal edge portion 38 is selected to accommodate a range of joist angles, which correspond to different rises of the stair assembly 10. According to one embodiment, the angle is in a range of 15-35 degrees, for example approximately 30 degrees.

Any suitable contour including a straight bottom edge 36 is contemplated by the present disclosure. The bottom edge 36 need only extend sufficiently to allow a fastener to be received through a lower portion of the lateral walls 32 and into respective lateral walls 22 of the joists 12. In certain applications, the lowest step may require a lower portion of the lateral walls 32 of the brackets 14 to be cut away by the installer such that the stair step support bracket 14 seats properly on the joist 12 without interfering with the ground or other support surface.

The stair step support bracket 14 may be formed from any suitable metal, such as 16 gauge steel or 14 gauge steel. The metal may be sheared or otherwise cut to form a blank that may be folded into the bracket 14 shown in FIG. 2. According to one embodiment, the metal, either after cutting the blank shape or prior to cutting the blank shape, may be punched to form the fastener and positioning through holes in the lateral walls 32 as described in more detail below. The positioning through holes correspond to multiple different rise dimensions of the stair assembly 10.

The sheet metal blank may be folded to form the stair step bracket 14 shown in FIG. 2. For example, each of the lateral walls 32 may be formed by bending the punched blank at the respective junctions with the upper wall 30 approximately 90 degrees. The front wall 34 may be formed by bending it 90 degrees. The free end of the front wall 34 may be spot welded or otherwise secured to the opposite lateral wall 32 from which it was bent. According to one embodiment, the sheet metal is bent using a press brake forming machine.

The front wall 34 only extends partially down the front portion of the lateral side walls 32. The rear of the bracket 14 opposite the front wall 34 may be open. The lateral walls 32 straddle the joist 12, which allows the lateral walls 32 of the stair support 14 to be secured to the lateral walls 22 of the joist 12 in multiple different positions corresponding to multiple different rise dimensions, as discussed in more detail below.

Along the bottom edge 36, for example the angled edge portion 40, a plurality of fastener holes 42 may be preformed by a punch press that shears the sheet metal. According to alternate embodiments, the fastener holes 42 may be formed by the installer in connection with installation. With reference to FIG. 1, a fastener 44 is received through each fastener hole 42 and the fastener penetrates the lateral wall 22 of the joist 12.

Disposed at a front portion of each of the lateral walls 32 of a bracket 14 are a plurality of aligned front positioning holes 46, and disposed at a rear portion of the lateral walls 32 is a plurality of aligned rear positioning holes 48. The front positioning holes 46 disposed a greater distance from the upper wall 30 correspond to increasing rise dimensions.

To simplify installation of the brackets 14 to the joists 12, a first set pin 50 is received through a pair of front positioning holes 46, and a second set pin 50 is received through pair of rear positioning holes 48. The positioning holes 46, 48 are preformed to correspond to multiple different stair rise dimensions. Each pair of front positioning holes 46 corresponds to a pair of rear positioning holes 48 for a predetermined rise dimension. An installer may employ the same positioning holes 46, 48 for each stair step support bracket 14 to ensure each stair step of the stair assembly 10 has the same rise dimension. Installing the support brackets with the same repeatable rise dimension is simplified and precise measuring by the installer can be reduced.

The set pin 50 includes a head 52 and a shaft 54. The shaft 54 is received through the positioning holes 46, 48, and the head 52 prevents the pin 50 from sliding completely through the positioning holes 46, 48. The head 52 also allows the set pin 50 to be easily gripped by the installer. According to certain embodiments, the pin 50 is formed from a durable metal, such as steel. According to an alternate embodiment, the set pin is formed from a polymeric material, for example nylon. According to one embodiment, the set pins 50 are formed of Nylon 66. The set pin 50 may be used for temporary positioning, and therefore can be removed and discarded after the stair step support bracket is fastened to the joist. Thus, a less expensive material, such as nylon may be used for a pair of disposable set pins 50 that may be sold with the bracket 14. The set pin 50 may be fabricated using any suitable polymer forming process, such as injection molding.

Figure 3A:
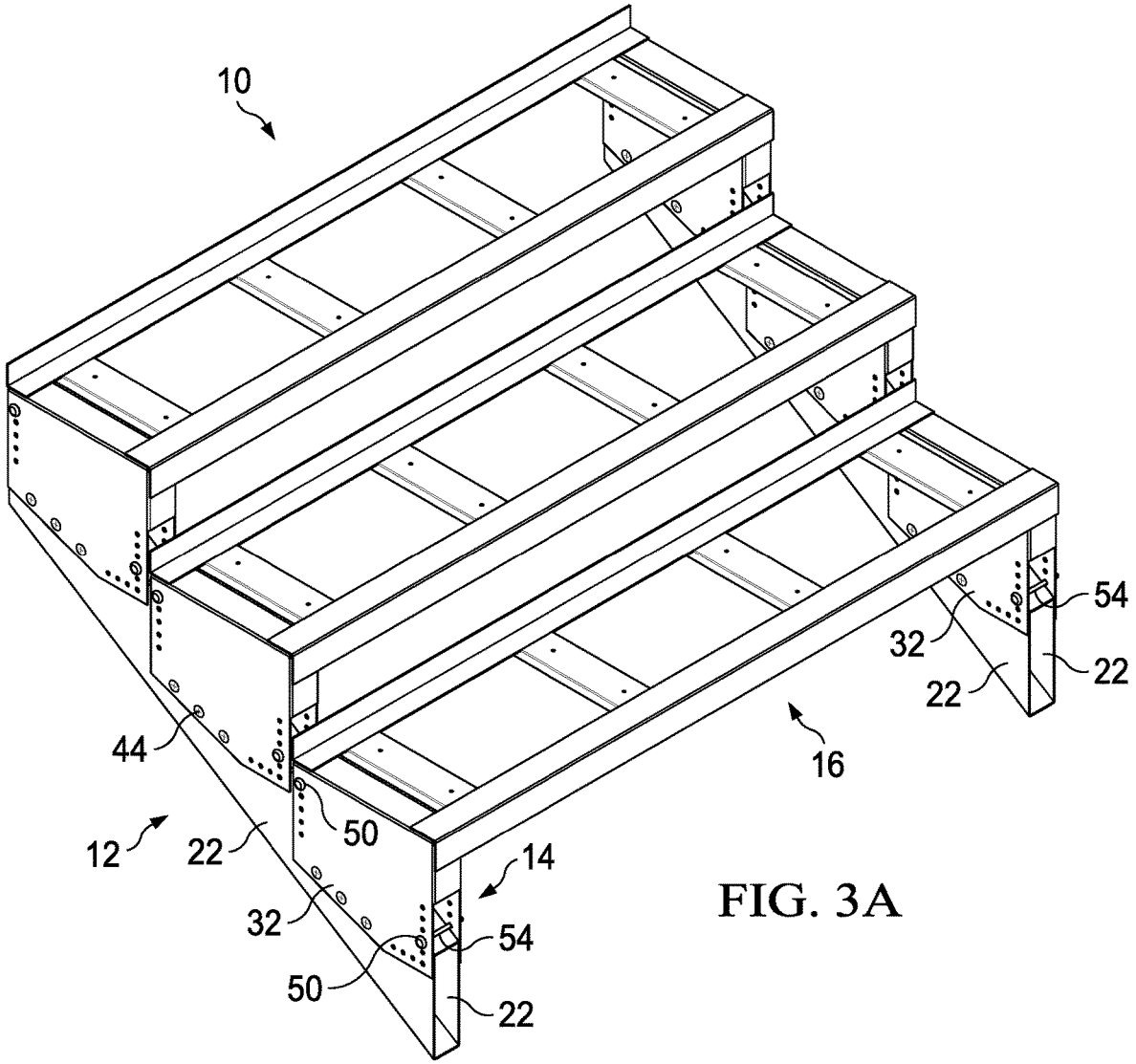
FIGS. 3A and 3B are stair stringers having different rise dimensions formed with the adjustable stair step support of FIG. 2.

To properly position the adjustable stair step support 14 to correspond to a seven inch rise, a first set pin 50 is received through a first set of aligned front positioning holes 46 in each lateral wall 32 of a bracket 14 that correspond to a seven inch rise, and a second set pin 50 is received through a corresponding set of aligned rear positioning holes 48 in each lateral wall 32 of the same bracket 14. According to one embodiment, the front positioning holes 46 may have a specific geometry, for example a hole with a diamond geometry, and the rear positioning holes 48 corresponding to a seven inch rise also has a diamond shape geometry. A stair assembly 10 with a seven inch rise is shown in FIG. 3A.

The adjustable stair step support 14 may also be used to form a stairway with a 7 and ¾ inch rise by inserting the pins 50 in other holes 46, 48, for example the front positioning holes 46 and the rear positioning holes 48 corresponding to a seven and ¾ inch rise. According to one embodiment, the seven and ¾ inch rise front and rear positioning holes 46, 48 may have the same geometry that is different from the geometry of the seven inch positioning holes. For example, the seven and ¾ inch front and rear positioning holes 46, 48 may have a hexagonal geometry. Alternatively, the seven and ¾ inch front and rear positioning holes 46, 48 may have a triangular geometry, which may be more easily identifiable to the installer to reduce mistakes in choosing the proper pair of holes 46, 48 in which to insert the set pins 50. Hex or triangular setting holes 56 and diamond setting hole 58 may be frequently employed common stair rises for example, 7 and 7 and ¾ inches.

After inserting the set pins 50 in the desired front and rear positioning holes 46, 48, for example the diamond shaped positioning holes 46, 48 that correspond to a rise of seven inches, the adjustable stair step support 14 may be set on the joist 12 such that the shafts 54 of the pins 50 rest on the upper wall 18 of the joist 12. The upper wall 30 of the adjustable stair step support 14 will be level and in a position to support a tray 16. The lateral walls 32 straddle and extend at least partially over the lateral walls 22 of the joists 12. The straddling of the lateral walls 32 position the fastener holes 42 aligned with the lateral walls 22 of the joists 12 such that they may receive fasteners 44 to secure the adjustable stair step support brackets 14 to the joist 12. According to an alternate embodiment, the adjustable stair support brackets 14 may be positioned and secured to the joists 12 prior to installing the joists at an angle to form the stair assembly 10.

Figure 3B:
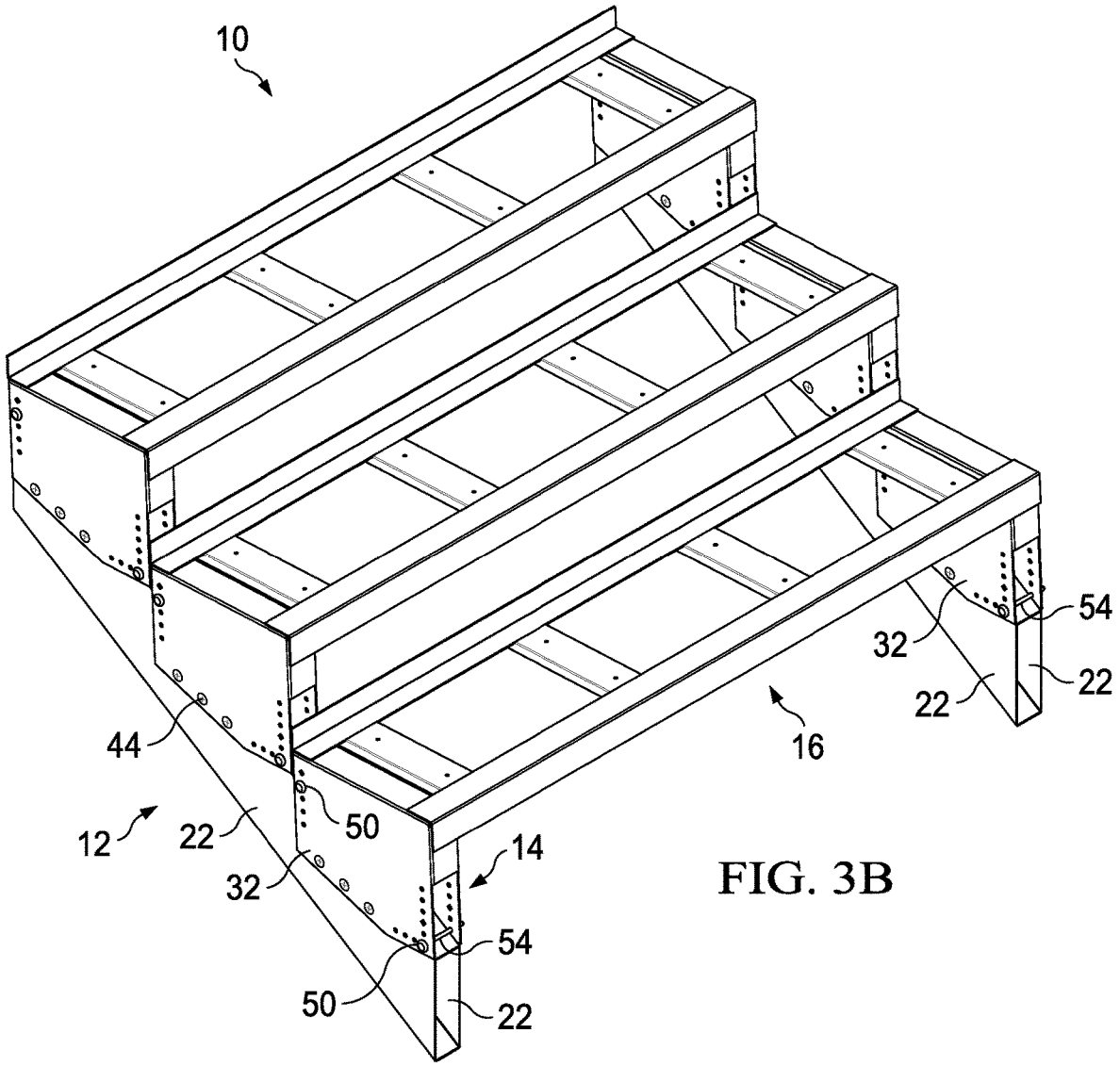

FIG. 3B illustrates an assembled stair assembly with a 7 and ¾ inch rise. Once the adjustable stair step support 14 is fastened to the joist 12, the set pins 50 may be removed. The set pins 50 may be used to properly position a subsequently fastened stair step support bracket 14. Alternatively, the set pins 50 may remain in the holes 46, 48 for additional support of the trays 16 and the step support surfaces.

A tray 16 is positioned such that the front angle bar 26 is received over part of the upper wall 30 and the front wall 34 of the adjustable stair step support 14. According to alternate embodiments, the rear angle bar 24 may overhang the tray support surface 30 and contact the upper wall 18 of the joist 12 and/or the front angle bar 26 may slightly overhang the tray support surface 30.

The upper wall 30 has a length in a range of approximately 8-12 inches, for example approximately 9 and ¾ inches. The length of the upper wall 30 corresponds to the run dimension of the stair assembly 10. The next pair of adjustable stair step support brackets 14 are then positioned behind the fastened adjustable stair step support 1 brackets 14 and contact the rear angle bar 24 or the lower brackets 14 using the set pin 50 procedure described above. In this manner, the stair assembly 10 is built. Alternatively, an upper pair of brackets 14 may be horizontally spaced apart from a lower pair of brackets a predetermined distance measured by the installer. The support surface can then be laid on and fastened to the stair assembly to form the treads and the risers (not shown) of a stairway. The treads and risers may be formed of any suitable material, such as wood or wood and polymer composite material.

The positioning holes correspond to a rise range of 6.5 inches to 8.5 inches, for example 7 and ¾ inches. Mixing and matching front and rear positioning holes yields almost infinite rise dimensions, particularly in light of the wide range of possible run dimensions. The dimensions of the adjustable stair step supports can be modified during fabrication to support a run in the range of 9 and ¾ inches to 61 inches using multiple brackets 14 positioned at the same level to support a wider tray 16.

The adjustable stair step supports 14 may be formed by punching the fastener holes 42, the front positioning holes 46, and the rear positioning holes 48 including the specific geometric shapes, such as diamond, hexagonal, or triangular. The hole punched sheet metal is then bent, for example by a press brake forming machine, to the shape shown in FIG. 2. Subsequent operations may include welding, such as spot welding, and powder coating the punched and formed bracket to reduce possible corrosion and create a desirable aesthetic.

Figure 4:
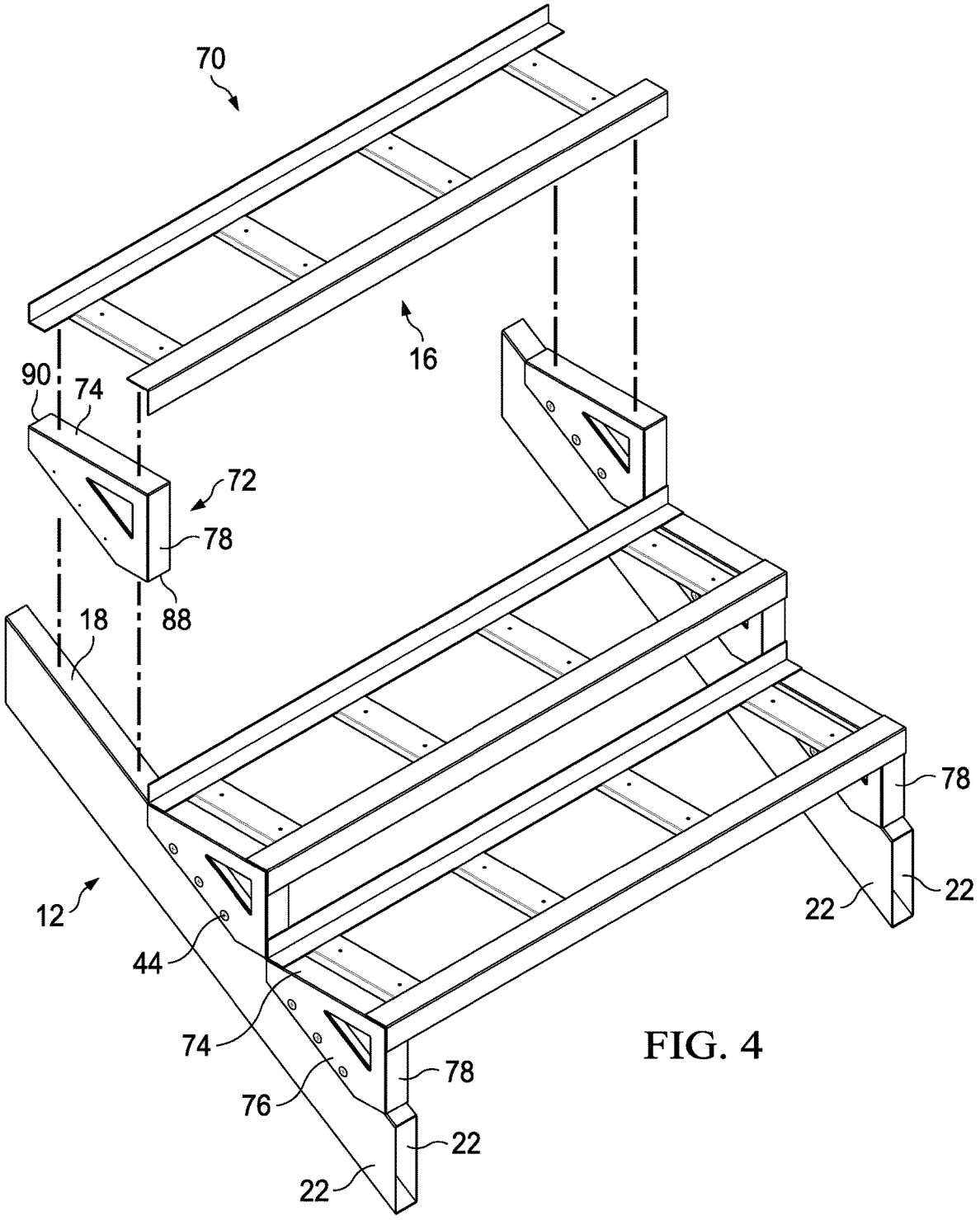
FIG. 4 is an alternate embodiment of a stair stringer employing preset stair step support brackets according to an embodiment of the present disclosure.

FIG. 4 is an alternate embodiment showing a stair assembly 70. Similar to the embodiment shown and described with respect to FIGS. 1-3B, the stair assembly 70 includes a pair of joists 12 and a plurality of trays 16. The joists 12 and trays 16 include the features described above. The stair assembly 70 also includes a preset stair step support bracket 72, a pair of which support a tray 16.

Figure 5:
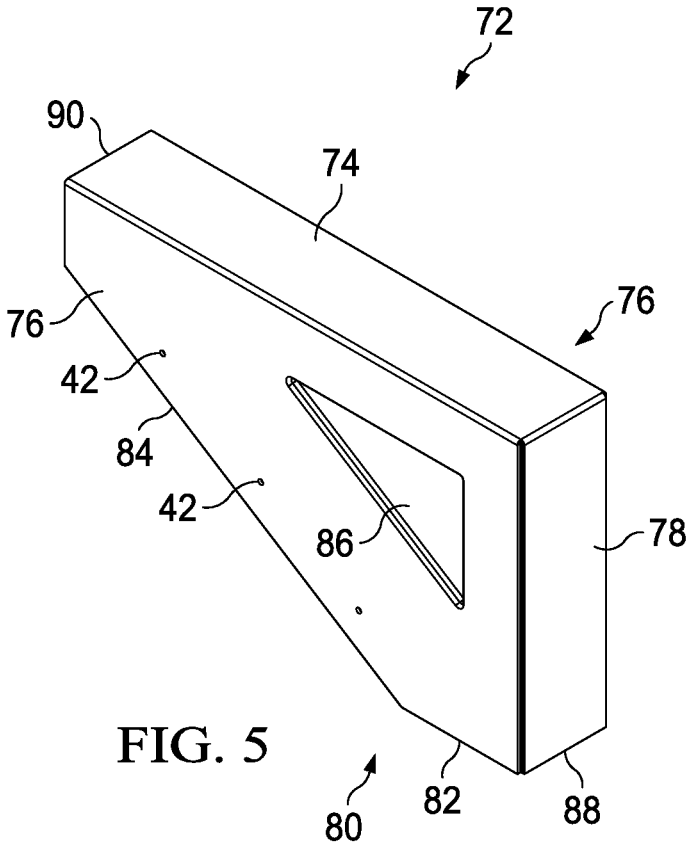
FIG. 5 is a perspective view of the preset stair step support shown in FIG. 4.

A perspective view of the preset stair step support bracket 72 is shown in FIG. 5. The preset support bracket 72 includes an upper wall 74 and a pair of lateral walls 76 (only one lateral wall 76 is shown) extending from the upper wall 74. The lateral walls 76 may be identical to each other. A front wall 78 extends from the upper wall 74 and closes a gap between the lateral walls 76. A lower edge 80 of the lateral walls 76 includes a horizontal edge portion 82 and an angled edge portion 84. A plurality of fastener holes 42 extend parallel to the angle portion 84. Alternatively, the fastener holes 42 may be formed by the installer during installation. A length of the upper wall 74 corresponds to an 11 inch run of a stair step. The front wall 78 corresponds to a preset rise of a stair riser, for example 7 inches, or alternatively 7 and % inches. The preset stair step support 72 is formed by punching a shape from a sheet of metal to form a blank. The blank is bent using a press brake forming machine into the shape shown in FIG. 5. According to some embodiments, a triangular depression 86 may be stamped into the lateral walls 76. The depression 86 may increase the strength and rigidity of the preset stair step bracket 72. The preset stair support bracket 72 may be welded, such as spot welded, to more securely join adjacent wall and may be powder coated to reduce possible corrosion.

To install the preset stair step support bracket 72 to the joists 12 and form the stair assembly 70, the preset stair support bracket 72 is positioned on the angled joist 12 such that a lower edge 88 of the front wall 78 rests on the upper wall 18 of the joist 12. A rear edge 90 of the upper wall 74 also rests on the upper wall 18 of the joist 12. The upper wall 74 of the preset support 72 is level, the lateral walls 76 straddle the joist 12, and the preset stair step support 72 is in position to form stairs of a certain preset rise, for example 7 inches. Fasteners 44 are received through the fastener holes 42 and penetrate the lateral walls 22 of the joists 12. The tray 16 is positioned over the preset stair step supports 72, and another preset stair step support 72 is positioned behind the fastened preset support 72 in contact with the rear angle bar 24 of the tray 16 or lower preset stair support bracket 72, as shown in FIG. 4. According to an alternate embodiment, the preset stair support brackets 72 may be positioned and secured to the joists 12 prior to installing the joists at an angle to form the stair assembly 70.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. All such variations are within the scope of the disclosure.

It is important to note that the construction and arrangement of the assemblies as shown in the various exemplary embodiments is illustrative only. Additionally, any element disclosed in one embodiment may be incorporated or utilized with any other embodiment disclosed herein. For example, the exemplary embodiment described with respect to FIGS. 4-5 may be incorporated in the exemplary embodiment described with respect to FIGS. 1-3B. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A stair assembly, comprising:

at least one joist comprising an upper wall, a first lateral wall extending from the upper wall, and a second lateral wall extending from the upper wall; and at least one stair step support bracket comprising a tray support wall, a first side wall extending from the tray support wall, and a second side wall extending from the tray support wall, the first and second side walls defining a pair of first front aligned positioning holes, said pair of first front aligned positioning holes defined by a respective hole in each side wall configured to receive a first set pin and a pair of first rear aligned positioning holes, said pair of first rear aligned positioning holes defined by a respective hole in each side wall configured to receive a second set pin, the pairs of first front and rear aligned positioning holes disposed such that when the first and second set pins received therethrough contact the upper wall of the at least one joist, the tray support wall is positioned at a first rise dimension.

2. The stair assembly of claim 1 wherein the first side wall further defines at least one fastener hole disposed to receive a fastener therethrough.

3. The stair assembly of claim 1 wherein the first and second side walls further define a pair of second front aligned positioning holes configured to receive the first set pin and a pair of second rear aligned positioning holes configured to receive the second set pin, the pairs of second front and rear aligned positioning holes disposed such that when the first and second set pins received therethrough contact the upper wall of the at least one joist, the tray support wall is positioned at a second rise dimension different from the first rise dimension.

4. The stair assembly of claim 3 wherein the pairs of first front and rear aligned positioning holes have a first geometry and the pairs of second front and rear aligned positioning holes have a second geometry different from the first geometry.

5. The stair assembly of claim 1 further comprising a tray configured to be supported by the at least one stair step support bracket.

6. The stair assembly of claim 5 wherein the tray comprises a front angle bar separated from a rear angle bar by a plurality of spacer members.

7. A stair step support bracket, comprising:

a tray support wall;

a pair of side walls extending from the tray support wall;

a pair of first front aligned positioning holes, said pair of first front aligned positioning holes defined by a respective hole in each side wall;

a pair of first rear aligned positioning holes through the pair of side walls, the pairs of first front and rear aligned positioning holes corresponding to a first rise dimension;

a pair of second front aligned positioning holes, said pair of second front aligned positioning holes defined by a respective hole in each side wall; and a pair of second rear aligned positioning holes through the pair of side walls, the second front and rear aligned positioning holes corresponding to a second rise dimension different from the first rise dimension.

8. The stair step support bracket of claim 7 further comprising:

a first set pin configured to be received by the pair of first front aligned positioning holes or the pair of second front aligned positioning holes; and a second set pin configured to be received by the pair of first rear aligned positioning holes or the pair of second rear aligned positioning holes.

9. The stair step support bracket of claim 8 wherein the pairs of first front and rear aligned positioning holes are disposed such that setting the first and second set pins received therethrough on an upper wall of a joist positions the tray support wall at the first rise dimension.

10. The stair step support bracket of claim 9 wherein the pairs of second front and rear aligned positioning holes are disposed such that setting the first and second set pins received therethrough on the upper wall of the joist positions the tray support wall at a second rise dimension different from the first rise dimension.

11. The stair step support bracket of claim 7 wherein a first geometry of the pairs of first front and rear aligned positioning holes is different from a second geometry of the pairs of second front and rear aligned positioning holes.

12. The stair step support bracket of claim 11 wherein the first geometry is diamond-shaped and the second geometry is triangle-shaped.

13. The stair step support bracket of claim 7 wherein the pair of side walls each comprises a plurality of preformed fastener holes.

14. The stair step support bracket of claim 13 wherein each of the pluralities of fastener holes are disposed proximate respective bottom edges of the pair of side walls.

15. A method of fabricating a stair step support bracket, comprising:

forming, from a piece of sheet metal, a tray support wall, a pair of side walls, and a front wall each extending from the tray support wall;

punching a pair of first front aligned positioning holes, said pair of first front aligned positioning holes defined by a respective hole in each side wall;

punching a pair of first rear aligned positioning holes through the pair of side walls, the pairs of first front and rear aligned positioning holes corresponding to a first rise dimension;

punching a pair of second front aligned positioning holes, said pair of second front aligned positioning holes defined by a respective hole in each side wall;

punching a pair of second rear aligned positioning holes through the pair of side walls, the second front and rear aligned positioning holes corresponding to a second rise dimension different from the first rise dimension; and bending the piece of sheet metal such that each one of the pair of side walls and the front wall form a right angle with the tray support wall.

16. The method of claim 15 wherein the bending the piece of sheet metal comprises brake forming the piece of sheet metal.

17. The method of claim 15 further comprising spot welding each one of the pair of side walls to the front wall.

18. The method of claim 15 further comprising powder coating the piece of sheet metal.

* * * * *